US006444865B1

(12) United States Patent
Barre et al.

(10) Patent No.: US 6,444,865 B1
(45) Date of Patent: Sep. 3, 2002

(54) PROCESS WHEREIN A HYDROCARBON FEEDSTOCK IS CONTACTED WITH A CATALYST

(75) Inventors: Guy Barre; Taous Grandvallet Mahtout, both of Grand Couronne (FR)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/630,128

(22) Filed: Aug. 1, 2000

Related U.S. Application Data

(62) Division of application No. 09/388,780, filed on Sep. 2, 1999, which is a continuation of application No. 08/999,377, filed on Dec. 1, 1997.

(51) Int. Cl.[7] ..... C07C 13/465; C07C 5/10; C10G 45/00; C10G 45/04

(52) U.S. Cl. ..... 585/266; 585/269; 208/143; 208/217; 208/514 H

(58) Field of Search ..... 502/64, 74, 79, 502/80, 84; 585/266, 269; 208/143, 213, 217, 254 H

(56) References Cited

U.S. PATENT DOCUMENTS

| | | | | | |
|---|---|---|---|---|---|
| 3,779,899 | A | | 12/1973 | Mears | 208/143 |
| 3,869,521 | A | * | 3/1975 | Benson | 260/667 |
| 3,876,529 | A | * | 4/1975 | Michlmayr | 208/144 |
| 3,943,053 | A | | 3/1976 | Kovach et al. | 208/143 |
| 3,979,278 | A | * | 9/1976 | Hayes | 208/143 |
| 4,049,576 | A | * | 9/1977 | Kovach et al. | 252/441 |
| 4,082,651 | A | * | 4/1978 | Antos | 208/138 |
| 4,087,351 | A | | 5/1978 | Rausch | 208/139 |
| 4,093,671 | A | * | 6/1978 | Murtha et al. | 260/668 R |
| 4,097,410 | A | | 6/1978 | Gladrow | 252/455 Z |
| 4,202,758 | A | * | 5/1980 | O'Hara et al. | 208/143 |
| 4,238,366 | A | | 12/1980 | Antos | 252/441 |
| 4,251,392 | A | * | 2/1981 | Mauldin et al. | 252/439 |
| 4,259,212 | A | * | 3/1981 | Gladrow et al. | 252/455 Z |
| 4,419,271 | A | | 12/1983 | Ward | 502/65 |
| 4,492,769 | A | | 1/1985 | Blanchard et al. | 502/262 |
| 4,540,480 | A | | 9/1985 | Azuma et al. | 208/44 |
| 4,605,490 | A | * | 8/1986 | Balinsky et al. | 208/143 |
| 4,610,779 | A | * | 9/1986 | Markley et al. | 208/212 |
| 4,820,402 | A | * | 4/1989 | Partridge et al. | 208/111 |
| 4,828,676 | A | * | 5/1989 | Sawyer et al. | 208/57 |
| 4,839,320 | A | | 6/1989 | Trowbridge et al. | 502/66 |
| 4,880,787 | A | * | 11/1989 | Bundens et al. | 502/65 |
| 4,906,353 | A | | 3/1990 | Breckenridge et al. | 208/68 |
| 4,956,075 | A | | 9/1990 | Angevine et al. | 208/120 |
| 4,961,836 | A | | 10/1990 | Murphy | 208/111 |
| 5,288,396 | A | | 2/1994 | Ward | 208/111 |
| 5,318,692 | A | * | 6/1994 | Eberly, Jr. et al. | 208/120 |
| 5,362,697 | A | | 11/1994 | Fung et al. | 502/71 |
| 5,425,933 | A | | 6/1995 | Nakagawa | 423/706 |
| 5,437,855 | A | | 8/1995 | Valyocsik | 423/706 |
| 5,451,312 | A | * | 9/1995 | Apelian et al. | 208/143 |
| 5,486,498 | A | | 1/1996 | Verduijn | 502/66 |
| 5,510,309 | A | | 4/1996 | Chang et al. | 502/308 |
| 5,512,267 | A | | 4/1996 | Davis et al. | 423/705 |
| 5,558,851 | A | | 9/1996 | Miller | 423/702 |
| 5,689,024 | A | * | 11/1997 | Schmitt | 585/467 |
| 5,716,593 | A | | 2/1998 | Miller | 423/702 |
| 5,741,414 | A | * | 4/1998 | Waku et al. | 208/89 |
| 5,785,944 | A | | 7/1998 | Miller | 423/700 |
| 5,785,945 | A | | 7/1998 | Miller | 423/700 |
| 5,837,639 | A | | 11/1998 | Kresge et al. | 502/64 |
| 5,851,949 | A | | 12/1998 | Galpem et al. | 502/333 |

FOREIGN PATENT DOCUMENTS

| | | | |
|---|---|---|---|
| EP | 0178710 | 4/1986 | C10G/67/04 |
| EP | 0181254 | 5/1986 | B01J/37/20 |
| EP | 0247678 | 12/1987 | C10G/47/20 |
| EP | 0303332 | 2/1989 | C10G/45/54 |
| EP | 0329499 | 8/1989 | B01J/37/20 |
| EP | 0448435 | 9/1991 | B01J/37/20 |
| EP | 0512652 | 11/1992 | C10G/45/64 |
| EP | 0519573 | 12/1992 | B01J/29/12 |
| EP | 0553920 | 8/1993 | C10G/49/00 |
| EP | 0564317 | 10/1993 | B01J/37/20 |
| EP | 0611816 | 8/1994 | C10G/65/04 |
| GB | 1178594 | 1/1970 | C01B/33/28 |
| GB | 1546504 | 3/1976 | C10G/23/02 |
| WO | WO 93/02793 | 2/1993 | B01J/37/20 |
| WO | WO 94/25157 | 11/1994 | B01J/33/00 |

* cited by examiner

*Primary Examiner*—Stanley S. Silverman
*Assistant Examiner*—Cam N. Nguyen

(57) ABSTRACT

Catalyst comprising from 0.1 to 15% by weight of a noble metal selected from one or more of platinum, palladium, and iridium, from 2 to 40% by weight of manganese and/or rhenium supported on an acidic carrier, these weight percentages indicating the amount of metal based on the total weight of carrier. Use of this catalyst in a process wherein a hydrocarbon feedstock comprising aromatic compounds is contacted with the catalyst at elevated temperature and pressure in the presence of hydrogen. Process for the preparation of this catalyst, which process comprises incorporating the catalytically active metals into the carrier followed by drying and calcining.

9 Claims, No Drawings

PROCESS WHEREIN A HYDROCARBON FEEDSTOCK IS CONTACTED WITH A CATALYST

This is a continuation-in-part of application Ser. No. 09/388,780 filed Sep. 2, 1999, which is a continuation of application Ser. No. 08/999,577 filed Dec. 1, 1997, the entire disclosure of which is hereby incorporated by reference.

The present invention relates to a catalyst composition and to its use in hydroconversion processes, wherein a hydrocarbon oil comprising aromatic compounds is contacted with hydrogen in the presence of such a catalyst composition. A process for the preparation of the catalyst composition also forma part of the present invention.

Hydrotreating catalysts are well known in the art. Conventional hydrotreating catalysts comprise at least one Group VIII metal component and/or at least one Group VIB metal component supported on a refractory oxide support. The Group VIII metal component may be either based on a non-noble metal, such as nickel (Ni) and/or cobalt (Co), or may be based on a noble metal, such as platinum (Pt) and/or palladium (Pd). Useful Group VIB metal components include those based on molybdenum (Mo) and tungsten (W). The most commonly applied refractory oxide support materials are inorganic oxides such as silica, alumina and silica-alumina and aluminosilicates, such as modified zeolite Y. Specific examples of conventional hydrotreating catalysts are NiMo/alumina, CoMo/alumina, NiW/silica-alumina, Pt/silica-alumina, PtPd/silica-alumina, Pt/modified zeolite Y and PtPd/modified zeolite Y.

Hydrotreating catalysts are normally used in processes wherein a hydrocarbon oil feed is contacted with hydrogen to reduce its content of aromatic compounds, sulphur compounds and/or nitrogen compounds. Typically, hydrotreating processes wherein reduction of the aromatics content is the main purpose are referred to as hydrogenation processes, whilst processes predominantly focusing on reducing sulphur and/or nitrogen content are referred to as hydrodesulfurization and hydrodenitrogenation, respectively. Current environmental standards require that both aromatic content and sulphur and nitrogen content of i products are very low and it is generally expected that specifications for aromatics, sulphur and nitrogen will become more and more severe in the future. Accordingly, in the refining of hydrocarbon oil fractions the ability to deeply hydrogenate, deeply hydrodesulphurise and deeply hydrodenitrogenate will become increasingly important.

Effective hydrogenation of monoaromatic compounds normally is difficult to achieve with the traditional hydrotreating catalysts. Conventional, dedicated aromatics hydrogenation catalysts, on the other hand, generally have a relatively low sulphur and/or nitrogen tolerance, so that they exhibit poor hydrogenation activity in the presence of substantial amounts of sulphur- and/or nitrogen-containing compounds. For this reason the conventional way for reducing the amounts of aromatics and sulphur- and nitrogen-containing compounds is a two-stage process with a first hydrodesulfurization and/or hydrodenitrogenation stage and, normally after removal of the hydrogen sulphide and ammonia formed, a second stage for hydrogenating the aromatics still left.

The present invention aims to provide a hydrotreating catalyst which exhibits an excellent aromatics hydrogenation activity, whilst at the same time having an excellent hydrodesulfurization and/or hydrodenitrogenation activity. This, consequently, implies that the catalyst composition should be able to effectively promote the hydrogenation of aromatics in the presence of substantial quantities of sulphur- and nitrogen-containing compounds. The present invention moreover aims to provide a hydrotreating catalyst exhibiting an excellent hydrogenation activity towards monoaromatics. It will be understood that the use of such a catalyst in a hydrotreating process offers an increased potential for meeting future low-content specifications for (mono) aromatics, sulphur and nitrogen.

Accordingly, the present invention in a first aspect relates to a catalyst composition comprising from 0.1 to 15% by weight of a noble metal selected from one or more of platinum, palladium and iridium, and from 2 to 40% by weight of manganese and/or rhenium, said weight percentages indicating the amount of metal based on the total weight of carrier, supported on an acidic carrier.

Manganese and rhenium both belong to Group VIIB of the Periodic Table of Elements. The third Group VIIB metal, technetium, is not useful due to its instability as will be appreciated by those skilled in the art. The catalytically active metals, i.e. platinum and/or palladium and/or iridium on the one hand and manganese and/or rhenium on the other hand, may be present in elemental form, as an oxide, as a sulphide or as a mixture of two or more of these forms. As will be discussed in detail hereinafter, a suitable preparation method used to prepare the present catalyst includes a final step of calcination in air, which will cause the catalytically active metals to be at least partially converted into their oxides. Usually such final calcination step will cause substantially all catalytically active metals to be converted into their oxides. If the catalyst is subsequently contacted with a sulphur-containing feed, then at least a part of these oxides will be sulphided and hence converted into the corresponding sulphides ("in situ" sulphidation). Very good catalyst performance has been observed in this situation and therefore it is considered a preferred embodiment of the present invention to have the catalytically active metals at least partly present in the catalyst as sulphides. Accordingly, the catalyst may also be subjected to a separate presulphiding treatment prior to being contacted with the feed. The degree of sulphidation of the metal oxides can be controlled by relevant parameters such as temperature and partial pressures of hydrogen, hydrogen sulphide, water and/or oxygen.

The metal oxides may be completely converted into the corresponding sulphides, but suitably an equilibrium state between the oxides and sulphides of the catalytically active metals will be formed, so that the catalytically active metals are present both as oxides and as sulphides.

As will be discussed in more detail below, the catalyst according to the present invention can suitably be used in a variety of hydroconversion processes. The catalyst has been found to be particularly useful in the hydrotreatment of gas oils, thermally and/or catalytically cracked distillates (such as light cycle oils and cracked cycle oils) and mixtures of two or more of these. These oils usually contain a relatively large amount of aromatic compounds, sulphur-containing compounds and nitrogen-containing compounds. The amounts of such compounds must usually be reduced in view of environmental regulations. Aromatic compounds reduction may also be desirable for reaching certain technical quality specifications, such as cetane number in the case of automotive gas oils, smoke point in the case of jet fuels and colour and stability in the case of lub oil fractions. When using the catalyst according to the present invention in the hydrotreatment of gas oils, thermally and/or catalytically cracked distillates and mixtures of two or more of these, the required reduction for e.g. meeting automotive gas oil specifications can be attained in a single stage. It has been found that the catalysts of the present invention are especially active in reducing the amount of mono-aromatics in the final product, even in the presence of substantial amounts of sulphur- and nitrogen-containing compounds.

The catalyst according to the present invention comprises as catalytically active metals from 0.1 to 15% by weight of platinum and/or palladium and/or iridium and from 2 to 40% by weight of manganese and/or rhenium. If lower amounts of catalytically active metals are applied, the activity of the catalyst becomes too low to be commercially attractive. If, on the other hand, the amount of catalytically active metals is higher than the upper limits indicated, the further increase in catalytic activity does not warrant the costs of the extra amount of metal. This applies in particular for platinum and palladium. Good results can be obtained with catalysts comprising from 3 to 10% by weight of noble metal, i.e. platinum and/or palladium and/or iridium and from 2, preferably from 5 to 30% by weight of manganese and/or rhenium.

With respect to the noble metal component, it is preferred to use palladium only, whilst of manganese and rhenium, rhenium is the preferred metal. A very much preferred catalyst, accordingly, is a catalyst comprising palladium and rhenium as the catalytically active metals.

The carrier used to support the catalytically active metals is an acidic carrier. Acidic carriers are known in the art. Examples of suitable carriers for the purpose of the present invention, then, include acidic carriers comprising an aluminosilicate or silicoaluminophosphate zeolite, amorphous silica-alumina, alumina, fluorided alumina, phyllosilicate or a mixture of two or more of these. It will be appreciated that the type of acidic carrier to be used largely depends on the intended application of the catalyst. For most applications it is, however, preferred that the carrier comprises a zeolite. Examples of suitable zeolites are siticoaluminophosphates, such as SAPO-11, SAPO-31 and SAPO-41 and aluminosilicate zeolites like ferrierite, ZSM-5, ZSM-23, SSZ-32, mordenite, beta zeolite and zeolites of the faujasite type, such as faujasite and the synthetic zeolite Y. The use of silicoaluminophosphates may, for instance, be considered when using the present catalyst in a process for producing lubricating base oils which involves a hydroconversion step. In general, however, the use of aluminosilicate zeolites is preferred. A particularly preferred aluminosilicate zeolite is zeolite Y, which is usually used in a modified, i.e. dealuminated, form. Particularly when using the catalyst according to the present invention as a hydrotreating catalyst for reducing the content of aromatics and sulphur- and nitrogen-containing compounds, the use of an acidic carrier comprising a modified zeolite Y is very much preferred. A particularly useful modified zeolite Y is one having a unit cell size below 24.60 Å, preferably from 24.20 to 24.45 Å and even more preferably from 24.20 to 24.35 Å, and a $SiO_2/Al_2O_3$ molar ratio in the range of from 5 or 10 to 150, e.g. from 5, 10 or 15 to 110 or from 5, 10, 15 or 30 to 90. Such carriers are known in the art and examples are, for instance, described in EP-A-0,247,678; EP-A-0,303,332 and EP-A-0,512,652. Modified zeolite Y having an increased alkali(ne) metal—usually sodium-content, such as described in EP-A0,519,573, can also be suitably applied.

In addition to any of the aforementioned carrier materials the carrier may also comprise a binder material. The use of binders in catalyst carriers is well known in the art and suitable binders, then, include inorganic oxides, such as silica, alumina, silica-alumina, boria, zirconia and titania, and clays. Of these, the use of silica and/or alumina is preferred for the purpose of the present invention. If present, the binder content of the carrier may vary from 5 to 95% by weight based on total weight of carrier. In a preferred embodiment, the carrier comprises 10 to 60% by weight of binder. A binder content of from 10 to 40% by weight has been found particularly advantageous.

The catalyst according to the present invention can be used in a variety of hydroconversion processes, wherein a hydrocarbon feedstock comprising aromatic compounds is contacted with the catalyst at elevated temperature and pressure in the presence of hydrogen. Specific examples of such processes are hydrocracking, lub oil manufacture (hydrocracking/hydroisomerization) and hydrotreating.

Accordingly, the present invention also relates to the use of the catalyst described above in a process wherein a hydrocarbon feedstock comprising aromatic compounds is contacted with the catalyst at elevated temperature and pressure in the presence of hydrogen. Since the present catalysts are active not only in hydrogenating aromatic compounds, but also in removing sulphur and/or nitrogen compounds, hydrocarbon feedstocks comprising sulphur and/or nitrogen containing compounds in addition to the aromatic compounds are particularly suitable.

The catalyst according to the present invention is, due to its excellent hydrotreating performance, particularly useful as the first stage catalyst in a two stage hydrocracking process. The second stage catalyst, then, is a dedicated hydrocracking catalyst.

In lubricating base oil manufacture processes at least one hydroconversion step may be included for removal of sulphur and/or nitrogen containing contaminants from the feedstock and/or hydrogenation of aromatic compounds and/or hydroisomerisation of straight chain and slightly branched hydrocarbons into further branched hydrocarbons and/or hydrocracking of waxy molecules (usually long chain paraffinic molecules or molecules containing tails of this type) into smaller molecules. For application in such lubricating base oil manufacture process, the catalyst according to the present invention will preferably comprise a carrier comprising amorphous silica-alumina, fluorided alumina or a zeolite with silica and/or alumina as binder. If the hydrotreating reactions are intended to occur predominantly, the use of carriers comprising modified zeolite Y is preferred. If cracking and/or hydroisomerisation of the waxy molecules is the main objective, preferred carriers comprise fluorided alumina, amorphous silica-alumina or zeolites, such as ferrierite, ZSM-5, ZSM-23, SSZ-32 and SAPO-11. A hydroconversion step in a lubricating base oil manufacture process typically comprises contacting a luboil feedstock at a temperature of between 200 and 450° C. and a pressure up to 200 bar with a suitable catalyst in the presence of hydrogen. Examples of lubricating base oil manufacturing processes, wherein the catalyst according to the present invention may be used, are disclosed in GBA-1,546,504 and EP-A0,178,710.

The catalyst according the present invention has been found to be particularly suitable for use in a hydrotreating process. Suitable hydrotreating operating conditions are a temperature in the range of from 200 to 450° C., preferably from 210 to 350 or 400° C., and a total pressure in the range of from 10 to 200 bar, preferably from 25 to 100 bar. Examples of suitable hydrotreatment processes have been described in European Patent Application Publication Nos. 0,553,920 and 0,611,816. Suitable feedstocks for such a hydrotreating process are catalytically cracked gasolines, gas oils, light gas oils, thermally and/or catalytically cracked distillates (such as light cycle oils and cracked cycle oils) and mixtures of two or more of these. Many of these feedstocks normally comprise at least 70% by weight of hydrocarbons boiling between 150 and 450° C. When used in such a hydrotreating catalyst, it is preferred that the carrier comprises a binder in an amount as indicated above. The preferred acidic material in the carrier in case of hydrotreating is an aluminosilicate zeolite, most preferably modified zeolite Y. It has been found that the present catalyst exhibits an excellent hydrotreating activity and is particularly effective in hydrogenating mono-aromatics, even in the presence of substantial amounts of sulphur- and nitrogen-containing compounds. In addition, the present catalyst is also very effective in the hydrogenation of di-aromatics and higher aromatics (tri+aromatics).

The present invention also relates to a process for preparing the catalysts described above, which process comprises incorporating the catalytically active metals into the refractory oxide carrier, suitably by means of impregnation or ion-exchange techniques, followed by drying and calcining and optionally presulphiding. In order to obtain catalysts having a particularly good catalytic activity, this process can be carried out by the subsequent steps of:

(a) impregnating the carrier with one or more solutions containing a noble metal compound selected from compounds of platinum, palladium and iridium, and one or more solutions containing a manganese and/or rhenium compound, optionally with intermediate drying and/or calcining; and (b) drying and calcining the thus impregnated carrier at a temperature in the range of from 250 to 650° C.

A preferred method of impregnating the carrier is the so-called pore volume impregnation, which involves the treatment of a carrier with a volume of impregnating solution, whereby said volume of impregnating solution is substantially equal to the pore volume of the carrier. In this way, full use is made of the impregnating solution. For the purpose of the present invention this impregnation method has been found to be particularly suitable as the resulting catalysts show a particularly good performance. The impregnation step (a) can be carried out using one impregnation solution containing all metal components or can be carried out in two separate impregnation steps, one step for impregnation with platinum and/or palladium and/or iridium and one step for impregnation with manganese and/or rhenium, possibly with an intermediate drying and/or calcining step.

Metal compounds which can be used in the impregnating solutions for preparing the catalysts according to the present invention, are known in the art. Typical manganese compounds are salts thereof which are soluble in water, such as manganese sulphate, manganese nitrate and manganese acetate. Typical rhenium compounds are perrhenic acid, ammonium perrhenate and potassium perrhenate. Typical palladium compounds for use in impregnating solutions are tetrachloropalladium acid ($H_2PdCl_4$), palladium nitrate, palladium(II) chloride and its amine complex. The use of $H_2PdCl_4$ is preferred. Typical platinum compounds for use in an impregnating solution are hexachloroplatinic acid ($H_2PtCl_6$), optionally in the presence of hydrochloric acid, platinum amine hydroxide and the appropriate platinum amine complexes.

It is common practice in catalyst preparation, to subject the catalysts in the final step to calcination in air, whereby the metals are brought in the form of their oxides. To convert the metals at least partially into their sulphides, the catalyst can be presulphided after the final calcination step and prior to contact with the feedstock. Suitable presulphiding methods are known in the art, such as for instance from European Patent Application Publication Nos. 0,181,254; 0,329,499; 0,448,435 and 0,564,317 and International Patent Application Publication Nos. WO 93/02793 and WO 94/25157. Accordingly, in a further embodiment of the present invention, the process for preparing the catalyst comprises the further step of:

(c) subjecting the dried and calcined catalyst to a presulphiding treatment.

Instead of the aforementioned presulphiding methods, presulphiding can also take place via in situ presulphidation. This involves contacting the calcined catalyst with a sulphur-containing hydrocarbon on feedstock under appropriate conditions, which are normally less severe than the conditions applied during the envisaged operation.

The catalyst according to the present invention can be regenerated by methods known in the art. A typical method for recovery of the catalytically active metals from spent catalyst comprises removing the deactivated catalyst from the reactor, washing the catalyst to remove the hydrocarbons, burning off the coke and subsequently recovering the noble metal(s) and the manganese and/or rhenium.

The invention is illustrated by the following examples without restricting the invention to these particular embodiments.

EXAMPLE 1

An acidic carrier consisting of 80% by weight dealuminated zeolite Y (unit cell size of 24.25 Å and silica/alumina molar ratio of 80) and 20% by weight of an alumina binder was used. A sample of this carrier was impregnated with an aqueous perrhenic acid ($HReO_4$) solution to reach 20%wt $ReO_2$ (corresponding with 17.1%wt of Re; said weight percentages being based on the weight of the carrier). The partially prepared catalyst was then dried and calcined for 2 hours at 400° C., after which impregnation with an aqueous solution of $H_2PdCl_4$ took place to reach a PdO content of 5% by weight (corresponding with 4.3% by weight of Pd). Finally, the completed catalyst was dried and calcined for 2 hours at 350° C. in air. The catalyst is further referred to as PdRe/Y.

EXAMPLE 2

A bed consisting of 20 $cm^3$ of the above PdRe/Y admixed with 80 $cm^3$ of silicon carbide particles (SiC; diameter 0.21 mm) was placed in a reactor. The PdRe/Y bed thus obtained was presulphided according to the method disclosed in EP-A-0,181,254. This method involved impregnation with di-tertiary nonyl polysulphide diluted in n-heptane, followed by drying for 2 hours at 150° C. under nitrogen at atmospheric pressure. The catalyst was subsequently activated by bringing the reactor on a total pressure of 50 bar with the help of hydrogen at a gas rate of 500 Nl/kg. The temperature was raised from ambient temperature to 250° C. in 2 hours, followed by the introduction of feed and increase of the temperature from 250 to 310° C. at a rate of 10° C./hr. The temperature of 310° C. was maintained for 100 hours.

After the activation procedure was completed a feed having the characteristics as indicated in Table I (BP is boiling point, IBP and FBP refer to initial and final boiling point, respectively) was passed over the bed of PdRe/Y. The feed was a blend of 75% by weight of a straight run gasoil and 25% by weight of a light cycle oil. Process conditions included a weight average bed temperature (WABT) of the PdRe/Y bed of 350° C., a total pressure of 50 bar, a gas rate of 500 Nl/kg and a weight hourly space velocity (WHSV) of 1.0 kg/l.h.

TABLE I

| Feedstock characteristics | | | |
|---|---|---|---|
| S (% wt) | 1.37 | BP Distribution (° C.) | |
| N (ppmw) | 228 | IBP | 150 |
| Aromatics (mmol/100 g) | | 10% wt | 229 |
| Mono | 77.3 | 50% wt | 287 |
| Di | 55.3 | 90% wt | 357 |
| Poly | 20.4 | FBP | 424 |

The sulphur content and nitrogen content (both in ppmw), the level of cracking expressed in % by weight of the material formed which has a boiling point below the IBP of the feed (i.e. 150° C.) and contents of mono-, di- and polyaromatics (in mmol/100 grams of product) were determined.

The results are indicated in Table II.

TABLE II

| Product characteristics | Product |
|---|---|
| S (ppmw) | 519 |
| N (ppmw) | 7.2 |
| cracking (% wt 150° C.⁻) | 2 |
| Aromatics (mmol/100 g) | |
| Mono | 66.0 |
| Di | 6.3 |
| Poly | 3.0 |

From Table II it can be seen that cracking of feedstock components into low boiling material is reduced to a minimum, whilst hydrodesulphurisation activity and hydrodenitrogenation activity of the PdRe/Y catalyst are excellent: sulphur- and nitrogen-content have been reduced with 96.2% and 96.8%, respectively.

Table II also shows that the aromatics conversion is very good. In this connection it should be borne in mind that the conversion of poly(tri+)aromatics and diaromatics initially increase the monoaromatics content. Conversions (in %wt) can be calculated by assuming that aromatics are hydrogenated through a sequential reaction pathway, i.e. it is assumed that the polyaromatics are converted into diaromatics, diaromatics into mono-aromatics and monoaromatics into naphthenics. This is a valid assumption, since it is known that hydrogenation of an aromatic ring contained in a polynuclear structure generally becomes kinetically less favourable as the number of aromatics ring in a polynuclear structure decreases. The monoaromatics which are found in the product may hence come from three sources: (i) from the unconverted monoaromatics already present in the feed, (ii) from converted diaromatics which were originally present in the feed and (iii) from converted diaromatics which, in return, originate from converted polyaromatics present in the feed. On the basis of the sequential pathway mechanism, the conversion levels of polyaromatics, diaromatics and monoaromatics were found to be as high as 85.3%, 91.3% and 54.1%, respectively.

EXAMPLE 3

The procedure of Example 2 was repeated except that a PdRe/Y catalyst was used comprising 5%w PdO (corresponding to 4.3%w Pd) and 5%w $ReO_2$ (corresponding to 4.3%w Re) on an acidic carrier consisting of 65%w modified zeolite Y (unit cell size of 24.32 Å and silica/alumina molar ratio of 9.2) and 35%w silica.

The feed was a blend of straight run gasoil and light cycle oil having the properties shown in Table III following and the process conditions used were exactly as before except that the feed was contacted with the catalyst at a temperature of 360° C.

TABLE III

| Feedstock characteristics | | | |
|---|---|---|---|
| S (ppmw) | 3900 | BP Distribution (° C.) | |
| N (ppmw) | 320 | IBP | 196 |
| Aromatics (mmol/100 g) | | 10% wt | 287 |
| Mono | 54.4 | 50% wt | 358 |
| Di | 24.8 | 90% wt | 403 |
| Tri | 9.8 | | |
| Poly (tri +) | 14.8 | FBP | 435 |

The sulphur content and nitrogen content (both in ppmw), the level of cracking expressed in % by weight of the material formed which has a boiling point below 150° C. and percentage conversions of mono-, di- and triaromatics were all determined.

The results are indicated in Table IV.

TABLE IV

| Product characteristics | Product |
|---|---|
| S (ppmw) | 380 |
| N (ppmw) | 39.0 |
| cracking (% wt 150° C.⁻) | 0.9 |
| Aromatics conversion (%) | |
| Mono | 50.2 |
| Di | 81.3 |
| Tri | 73.1 |

EXAMPLE 4

The procedure of Example 3 was repeated except that the process was carried out in mild hydrocracking mode (in contrast to the hydrotreating mode of Example 3) by increasing the process temperature to 380° C. All other process conditions remained the same.

The sulphur content and nitrogen content (both in ppmw), the level of cracking expressed in % by weight of the material formed which has a boiling point below 150° C., the percentage conversions of mono-, di- and triaromatics and the pour point were all determined.

The results are indicated in Table V.

TABLE V

| Product characteristics | Product |
|---|---|
| S (ppmw) | 24 |
| N (ppmw) | <1 |
| cracking (% wt 150° C.⁻) | 18.9 |

TABLE V-continued

| Product characteristics | Product |
|---|---|
| Aromatics conversion (%) | |
| Mono | 44.0 |
| Di | 85.1 |
| Poly | 85.1 |
| *Pour point (° C.) | −3 |

*Pour point of feedstock was 15° C.

We claim:

1. A hydrocarbon conversion process wherein a hydrocarbon feed stock comprising aromatic compounds and sulfur and/or nitrogen containing compounds is hydrogenated and at the same time hydrodesulfurized and/or dehydronitrogenated by contacting the feed stock with a catalyst comprising from 0.1 to 15% by weight of a noble metal selected from the group consisting of platinum, palladium, iridium, and mixtures thereof, and from 2 to 40% by weight of manganese and/or rhenium supported on an acidic carrier, said weight percentages indicating the amount of metal based on the total weight of carrier, wherein said acidic carrier is modified zeolite Y having a unit cell size below 24.60 Å, and a $SiO_2/Al_2O_3$ molar ratio in the range of from 5 to 150 at elevated temperature and pressure in the presence of hydrogen.

2. Process of claim 1 wherein the catalyst comprises from 3 to 10% by weight of noble metal and from 2 to 30% by weight of manganese and/or rhenium.

3. The process of claim 1 wherein the process is a hydrotreating process.

4. The process of claim 1 wherein the process is a lubricating base oil manufacture process.

5. The process of claim 1 wherein the process is a hydrocracking process.

6. The process of claim 1 wherein the hydrocarbon conversion is carried out at a temperature in the range of from 200 to 450° C.

7. The process of claim 6 wherein the catalyst comprises palladium and rhenium.

8. The process of claim 6 wherein the modified zeolite Y is a zeolite having a unit cell size from 24.20 to 24.45 Å.

9. The process of claim 1 wherein the acidic carrier comprises from 5 to 95% by weight of a binder.

* * * * *